United States Patent [19]

Leong

[11] 4,420,204

[45] Dec. 13, 1983

[54] DEAD-FRONT ELECTRICAL WIRING DEVICE ATTACHABLE TO A POWER CORD

[75] Inventor: Henry Leong, Kendall Park, N.J.

[73] Assignee: GTE Products Corporation, Stamford, Conn.

[21] Appl. No.: 285,209

[22] Filed: Jul. 20, 1981

Related U.S. Application Data

[63] Continuation of Ser. No. 95,734, Nov. 19, 1979, abandoned.

[51] Int. Cl.[3] ..... H01R 13/512; H01R 13/58

[52] U.S. Cl. ..... 339/63 R; 339/107

[58] Field of Search ..... 339/63 R, 63 M, 107, 339/196 R, 196 A, 196 M, 210 R, 210 M, 206 R, 206 P, 208

[56] References Cited

U.S. PATENT DOCUMENTS

| | | | |
|---|---|---|---|
| 3,784,961 | 1/1974 | Gartland, Jr. | 339/107 |
| 3,879,099 | 4/1975 | Shaffer | 339/107 |
| 4,010,999 | 3/1977 | Hoffman | 339/107 |
| 4,067,634 | 1/1978 | Hoffman | 339/107 |
| 4,138,185 | 2/1979 | Jaconette, Jr. | 339/107 |
| 4,191,444 | 3/1980 | Smith et al. | 339/107 |
| 4,196,956 | 4/1980 | Hoffman | 339/107 |
| 4,202,590 | 5/1980 | Hoffman | 339/107 |

FOREIGN PATENT DOCUMENTS

| | | | |
|---|---|---|---|
| 977312 | 11/1950 | France | 339/210 M |
| 1394871 | 3/1965 | France | 339/107 |
| 622051 | 4/1949 | United Kingdom | 339/107 |
| 676144 | 7/1952 | United Kingdom | 339/107 |

OTHER PUBLICATIONS

One-Piece Attachment Plugs, General Electric, Wiring Device Department, 2 pp., 43F-7800, 1978.

*Primary Examiner*—Neil Abrams
*Attorney, Agent, or Firm*—David M. Keay

[57] ABSTRACT

Disclosed is an electrical wiring device attachable to a power cord, formed of two pieces, and having a dead-front supporting contact elements of the male or female type. One of the pieces comprises the dead-front and the contact elements that it supports, integrally hinged to a first sidewall member. The dead-front in an outwardly swung position exposes the contact element terminals in a manner to facilitate connection of the power cord conductors to the terminals. When the connection is made, the dead-front is swung inwardly to a position in which the conductor lies upon the first sidewall member. A second sidewall member or cover, forming the other piece, is then slidably interengaged with the inwardly swung dead-front responsive to movement of the cover into a position overlying the first sidewall member. When fully interengaged with the dead-front, the cover cooperates with the dead-front and with the first sidewall member in defining an insulated, fully enclosed housing within which the terminals are confined. The cover and the first sidewall member have cooperating strain-relief means between which the power cord is clamped. In the assembled relation of the two pieces, screws captive in the first sidewall member are threadable into the cover to complete the assembly. The parts are in this way securely interlocked with the terminals completely enclosed in back of the dead-front of the device.

6 Claims, 15 Drawing Figures

DEAD-FRONT ELECTRICAL WIRING DEVICE ATTACHABLE TO A POWER CORD

This is a continuation of application Ser. No. 95,734, filed Nov. 19, 1979 now abandoned.

BACKGROUND OF THE INVENTION

1. Field of the Invention

The invention is in the field of electrical connectors, and in a more particular sense relates to those connectors attachable to the end of a flexible power cord and having a longitudinally divided housing of electrical insulation material adapted to grip the attached power cord, and having a strain relief means engaging the cord responsive to its assembly with the housing and with the terminals of the male or female contact elements of the device.

2. Description of the Prior Art

In recent years, it has become more and more important that devices of the character described be, in the first place, made as safe and fool-proof as possible. To this end, standards have been established within the industry, and requirements have been set forth for the industry by Underwriters Laboratories as well as by a variety of local, state, and federal agencies.

Apart from the importance of providing safe electrical connectors, the industry has moved toward the design of devices of this nature, such as to facilitate to the maximum extent possible the attachment of power cords to the devices. This has been important to the industry both from the standpoint of permitting the ordinary homeowner to connect power cords to attachment plug caps and female cord connectors, as well as from the standpoint of permitting assembly of the electrical connectors with power cords in industry, during the manufacture of electrical appliances of the type utilizing power cords.

From the standpoint of safety, it is now recognized that whether the device be an attachment plug or alternatively a mating, female connector, it should have a dead-front, a term used in the industry for electrical connector designs in which the contact elements are protectively mounted in an electrically insulative face or front member that is not removable, and which is disposed as a barrier in front of the terminals used for connecting the stripped ends of the conductors of the power cord to the contact elements of the device.

The provision of an electrical connector of the dead-front type obviously promotes safety, and thus aids in meeting the various standards established by Underwriters Laboratories and by the industry itself, as well as the standards established by various governmental agencies. However, it is recognized in the industry that ordinarily, the provision of a dead-front type of electrical connector involves a more expensive construction, by reason of the fact that normally, an excessive number of separate parts must be utilized in achieving the desirable result of a dead-front device of the character described. As a result, recent connector designs utilize the concept of housings integrally molded with movable portions, utilizing for example the concept of integral hinges or the like. This has led to the development of dead-front types of electrical connectors in which the housings are sometimes loosely but aptly described as being of the "valise" type, in the sense of utilizing opposed sidewall members integral with a dead-front, and adapted to be swung toward each other to a closed position from an initial, fully open arrangement. Such an arrangement is shown, for example, in patents such as U.S. Pat. No. 4,067,634 issued Jan. 10, 1978. Other devices, also formed with integral hinges, have been described, again aptly, as being of the "clam shell" type, a construction which again utilizes the concept of integrally joined, relatively swingable members movable between an open condition exposing the terminals for wiring purposes, and a closed position in which the terminals are concealed in back of a dead-front and the conductor is effectively clamped and strain-relieved between the housing portions.

In the prior art, the connectors heretofore designed, and described briefly above, have in many instances required extremely close tolerancing in respect to the molded portions of the housing, and have necessitated expensive molds, close inspection and quality control, and have had other deficiencies in respect to complete accessibility of the terminals for wiring purposes and effectiveness of the strain-relief means incorporated in the fully assembled device.

SUMMARY OF THE INVENTION

Summarized briefly, the invention is a generally improved dead-front electrical connector, utilizing relatively few parts, adapted for assembly both as a male or female type of connector, and designed to overcome the deficiencies noted in the prior art and discussed briefly above.

To this end, briefly described the connector constituting the present invention includes a body which is in the general form of a flat, plate-like member, hingedly connected to a dead-front adapted for supporting the contact assemblies, whether they be of the male or female type. Cooperating with these components is a cover, which like the body and dead-front is formed of molded electrically insulative material. The cover is formed with internal locking grooves, which cooperate with dove-tail tongues provided upon the dead-front. When the dead-front is swung to its use position, in which it is disposed approximately at right angles to the length of the body, the tongues are so disposed as to slidably engage in the locking grooves, responsive to bodily movement of the cover toward the plate-like body to which the dead-front is connected. Assembly is completed by means of assembly screws or equivalent fastening elements, that connect the body to the cover in the assembled relationship thereof. As a result, the dead-front is fixedly locked in position, with the terminals of the device fully enclosed rearwardly thereof, and will remain fully locked even if the integral hinge should fracture. Should the hinge fracture, the dead-front remains not only securely locked in assembled relationship with the cover and body, but also will still be tightly engaged against the body and cover in a manner to define an effective seal therebetween.

BRIEF DESCRIPTION OF THE DRAWING

While the invention is particularly pointed out and distinctly claimed in the concluding portions herein, a preferred embodiment is set forth in the following detailed description which may be best understood when read in connection with the accompanying drawings, in which:

DESCRIPTION OF THE PREFERRED EMBODIMENTS

In FIGS. 1-12, the invention has been illustrated as it appears when designed as an attachment plug cap, that is, the male version of the electrical connector.

Figure 8:
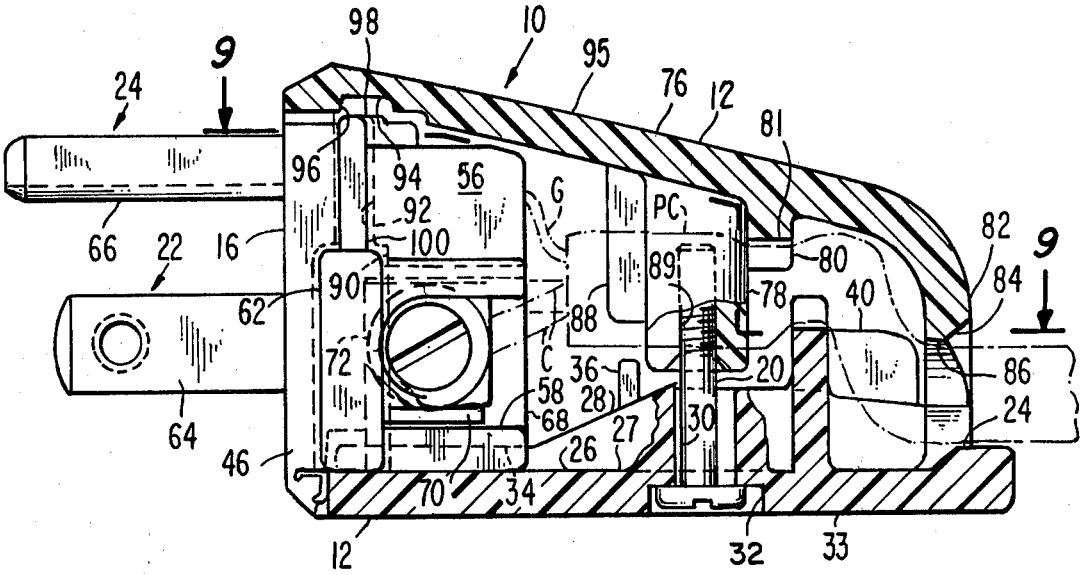
FIG. 8 is a longitudinal sectional view through the fully assembled device, as it appears when ready for use, taken substantially on line 8—8 of FIG. 3.
Figure 9:
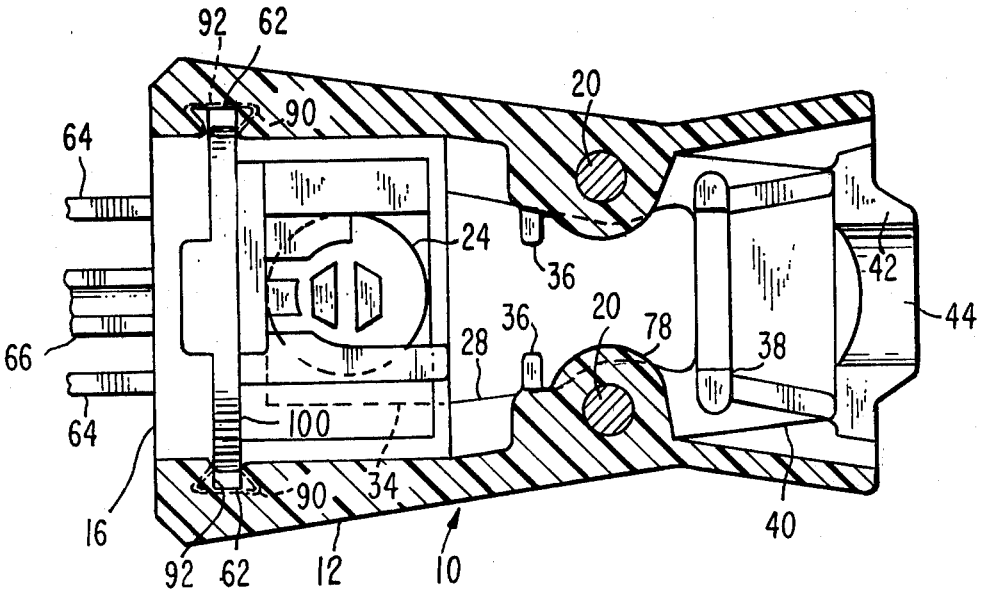
FIG. 9 is a sectional view through the fully assembled device, substantially on line 9—9 of FIG. 8.

In this form of the invention, the device includes an electrically insulative housing generally designated 10 comprising two complementary pieces molded of a thermoplastic material, preferably polypropylene. One of these pieces is a cover 12. The other comprises a body 14 and a dead-front 16 integrally joined by a hinge 18. The body may appropriately be considered as a first sidewall member, the dead-front an end wall member, and the cover a second sidewall member. The pieces, in their assembled relationship shown, for example, in FIG. 8, are connected in an interlocked, cord-clamping relationship by a pair of transversely spaced assembly screws 20.

Mounted on the end wall member 16, and completing the construction of the device, is a pair of current-carrying contact assemblies 22, and a ground contact assembly 24. It will be understood, in this connection, that any of a number of male contact configuration may be embodied in the device, according to the rated voltage and amperage capacities thereof. The illustrated configuration is merely one example and illustrates the widely used "U-ground" 15 A-125 V configuration.

Figure 5:
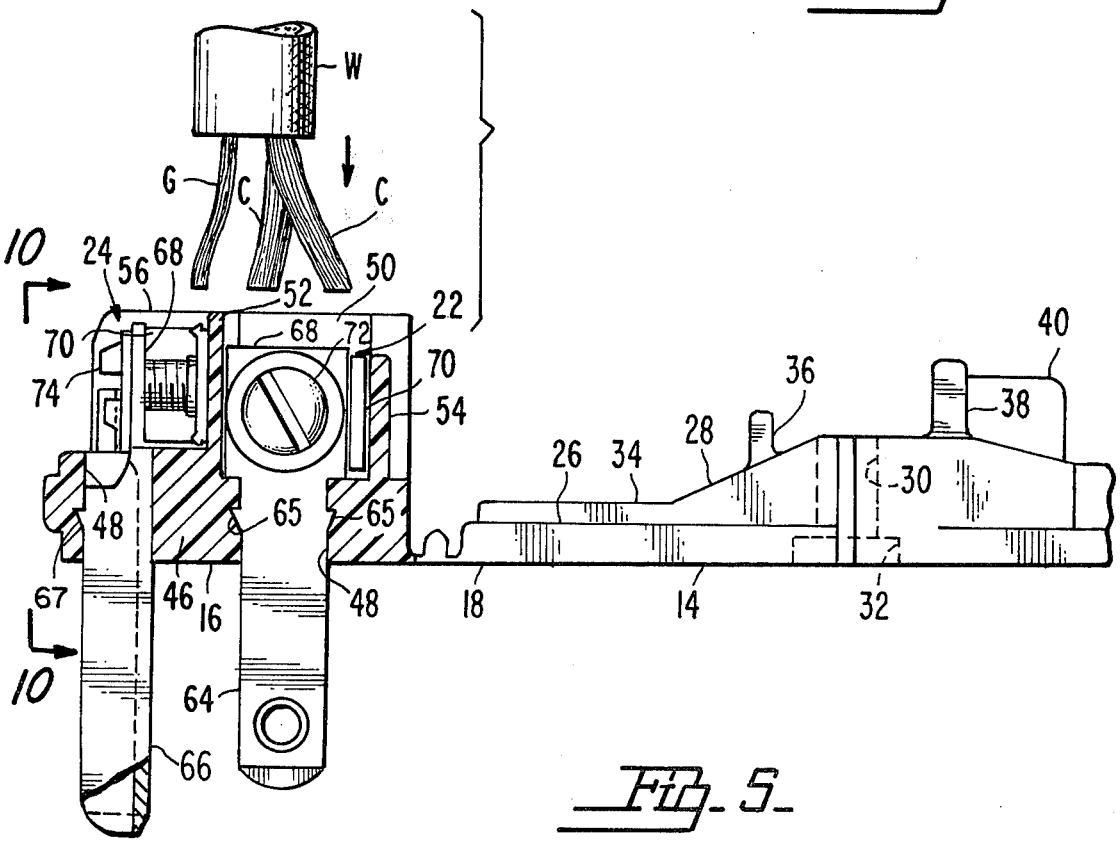
FIG. 5 is a view partly in side elevation and partly in longitudinal section, of the body and dead-front in open position, a power cord being illustrated fragmentarily as it appears preliminary to attachment thereof to the terminals of the device.
Figure 6:
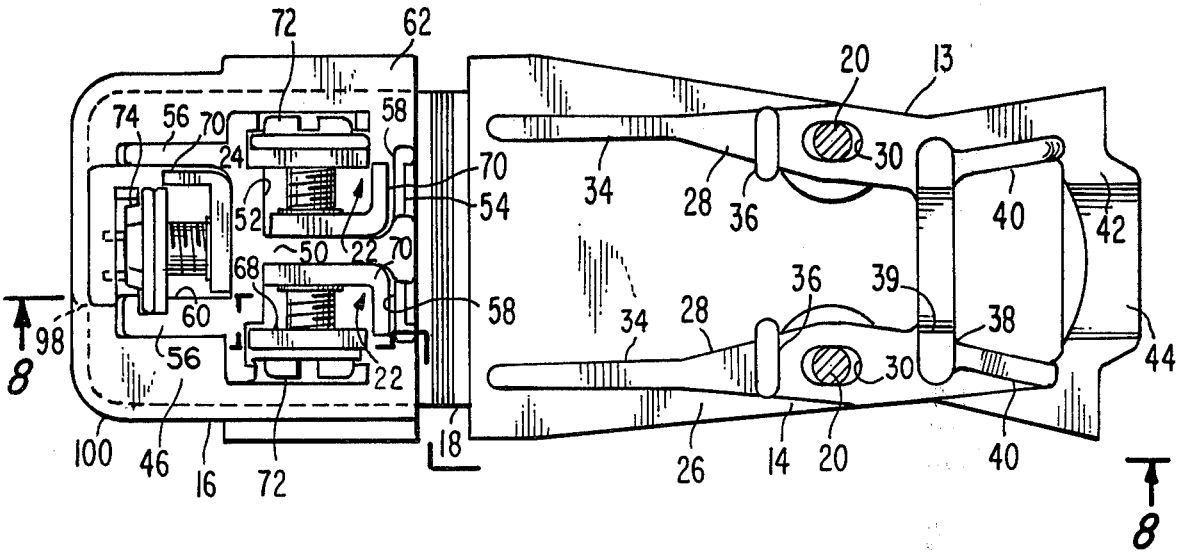
FIG. 6 is a top plan view of the body and dead-front in their initial, open condition, in which a pair of assembly screws carried by the body are illustrated in section.

In the attachment plug cap form of the invention illustrated in FIGS. 1-12, the body or first sidewall member 14 is formed with an elongated, flat base portion 26 which is seen, when viewed in top plan as in FIG. 6, as having a wide front or head end, the base portion being progressively narrowed in a direction toward the rear end thereof, that is, toward the right in FIG. 6, to a narrow waist portion 13 spaced forwardly a short distance from the rear end of the base portion. From the reduced-width waist portion 13 the flat base portion 26 is progressively increased in width to the rear extremity thereof.

Molded upon the flat inner face 27 of base portion 26 are elongated, transversely spaced ribs 28 formed with smooth-walled assembly-screw-receiving openings 30 having (see FIG. 8) communicating enlarged recesses 32 that open upon the outer face 33 of base portion 26 to accommodate the heads of the assembly screws 20.

Integral with the respective longitudinal ribs 28 are relatively low, parallel, elongated rib extensions 34 terminating close to the front edge of base portion 26, that is, the edge thereof merging into the integral hinge 18 by means of which the base portion is joined to the dead-front or end wall member 16.

As will be understood, the provision of the molded ribs 28 with their extensions 34 is adapted not only to provide means for receiving the assembly screws, but also, said ribs and rib extensions increase the resistance of the base portion to fracture upon accidental impact or under other conditions that may be normally expected during use of the device.

As shown to best advantage in FIGS. 6 and 8, integrally molded upon the respective ribs 28 are transversely extending locator lugs 36 disposed forwardly of a transversely disposed, molded strain-relief rib 38 having an arcuate depression 39 in its center adapted to receive a power cord PC.

Also molded integrally upon the inner surface of the base portion 26 are reinforcing gussets 40, extending rearwardly from the strain-relief rib 38. The gussets 40 terminate near the rear extremity of the base portion, having a wire entry 42, the central depression of which is arcuately formed and has been designated at 44.

Considering now the construction of the dead-front or end wall member 16, as previously noted this is integrally joined by a transversely disposed hinge 18 to the first sidewall member or body 14, and initially, may be regarded as extending in substantially co-planar relation to the base portion 26, as shown to best advantage in FIG. 5.

The particular construction details of the dead-front are thought to be best illustrated in FIGS. 5 and 6. As may here be noted, the dead-front includes a flat, approximately rectangular body part 46, one end edge of which is integral with hinge 18. The other end of the body part has rounded corners, in the illustrated embodiment, to provide a configuration that will mate with the correspondingly transversely rounded cover or second sidewall member 12.

Body part 46 is formed with transversely spaced blade slots 48 adjacent the rear or inner edge of the body part, the slots 48 being adapted to receive the current-carrying line and neutral contact elements of the illustrated embodiment of the device. Midway between the blade slots 48, a longitudinal center partition 50 is integrally molded upon the inner face of body part 46, and extends upwardly a substantial distance from the plane of the body part, to provide a barrier of insulation between the current-carrying contact assemblies 22. Integral with the longitudinal center partition 50 are transverse partitions 52, 54, and also molded upon the body part are side partitions 56 merging into the transverse partitions. The several partitions 50, 52, 54, 56 all cooperate to define a plurality of contact assembly recesses, in particular a pair of transversely spaced line and neutral contact assembly recesses 58, and a ground contact recess 60. The recesses are effectively insulated from one another by the partition arrangement illustrated and described.

Integrally molded upon the opposite side edges of the body part 46 are elongated dove-tail tongues 62 (see FIGS. 6 and 10) adapted to lockably engage in mating grooves of the cover or second sidewall member 12 in the assembled relationship of the several components of the housing.

Considering now the construction of the male contact assemblies used in the form of the invention shown in FIGS. 1–12, it may be observed (see FIGS. 5 and 6) that the current-carrying (that is, the line and neutral) contact elements 64 are formed as flat blades, projecting forwardly through the slots 48 and formed, within the slots, with teeth 65 that are embedded in the sidewalls of the blade responsive to forcing of the contact blade elements through the slots, to permanently assemble the contact elements 64 with body part 46 of the dead-front. The ground contact element 66 is a longer blade, of channeled cross section, also formed with teeth 67, for a similar purpose.

Figure 11:
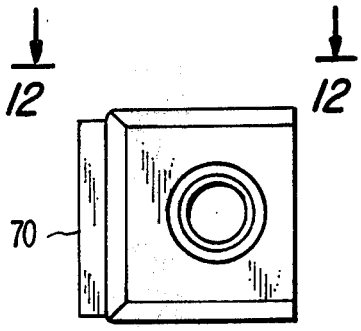
FIG. 11 is a front elevational view of one of the wire clamping nuts utilized in the attachment plug cap illustrated in FIGS. 1-9.
Figure 12:
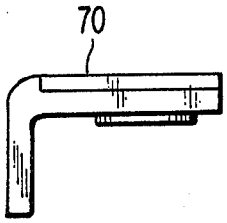
FIG. 12 is an elevational view of the wire clamping nut as seen from line 12—12 of FIG. 11.

The several contact elements 64, 66 have flat, rectangular, apertured heads 68, the apertures of which are registered with the threaded openings of L-shaped wire clamping nuts 70 disposed within the recesses 58, 60 and illustrated per se in FIGS. 11 and 12. The nuts 70 threadedly engage binding head screws 72 of the current-carrying contact elements, and a hex head screw 74 of the ground contact assembly 24. The apertures of the several contact elements loosely receive the screws, and thus, when the stripped ends of the power cord are to be engaged with the screw terminals of the several contact elements, the ends of the conductors are simply inserted between the nuts 70 and the heads 68 of the contact elements, after which the screws are rotated to draw the nuts toward the contact element heads, so as to cause said ends to be tightly clamped between the heads of the contact elements and the nuts.

Figure 1:
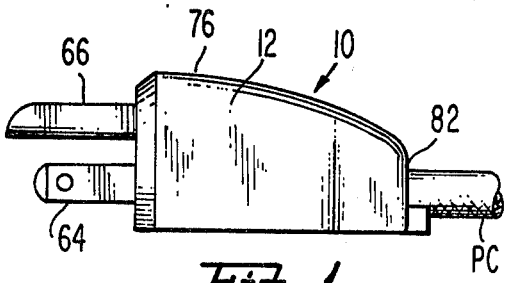
FIG. 1 is a side elevational view of an attachment plug cap according to the present invention.
Figure 2:
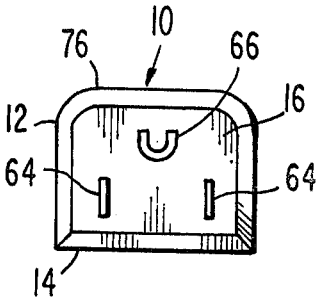
FIG. 2 is a front elevational view thereof.
Figure 3:
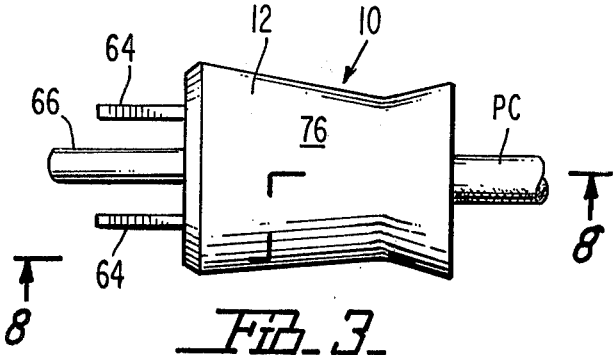
FIG. 3 is a top plan view.
Figure 4:
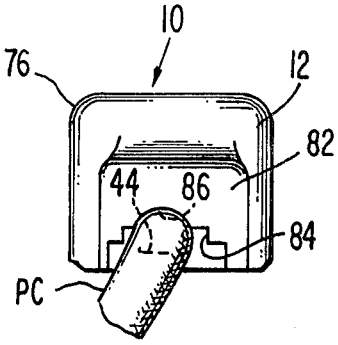
FIG. 4 is a rear elevational view.

Considering now the formation of the cover or second sidewall member 12, this, like the body 14, is molded of a suitable thermoplastic material, and includes an elongated channel-shaped shell 76. Shell 76, as seen from FIG. 1, is progressively decreased in height from its leading end, that is, the end nearer the contact elements, in the direction of its rear end, where it is formed for receiving power cord PC.

The body part or shell 76, as seen from FIG. 8, is internally molded with transversely spaced bosses 78, and adjacent the bosses 78, there is molded a transversely extending strain-relief rib 80 of the cover, centrally formed with an arcuate depression 81 adapted to receive the power cord PC. Strain-relief rib 80 is slightly offset longitudinally of the housing, from the strain-relief ribs 38 of the first sidewall member 14. Accordingly, when the cover and the body are assembled in the manner shown in FIG. 8, the insulation of the power cord PC will, as shown in that figure, be heavily crimped and clamped between the strain-relief ribs 38, 80, to produce a highly desirable and effective strain-relief for the cord. In addition, the arcuate depressions of the strain-relief ribs are offset to a substantial degree from the power cord entry recesses defined between the cover and the body part at the rear ends thereof, again as shown in FIG. 8, to afford yet another crimp and strain-relieving of the power cord.

As seen from FIG. 8, the cover is formed with a read end wall 82, having a wire entry recess 84 formed with an arcuate strain-relief rib 86. Strain-relief rib 86 is disposed opposite the wire entry recess 42 of the body or first sidewall member 14, thus to produce yet another area in which the insulation of the cord is compressed and strongly gripped by and between the assembled cover and body of the housing 10.

With further reference to the construction of the cover, adjacent and disposed just forwardly of the bosses 78, there are formed strengthening or reinforcing bosses 88, thus imparting maximum strength to the cover in the area in which the assembly screws 20 are engaged in threaded openings 89 formed in the respective bosses 78.

Figure 7:
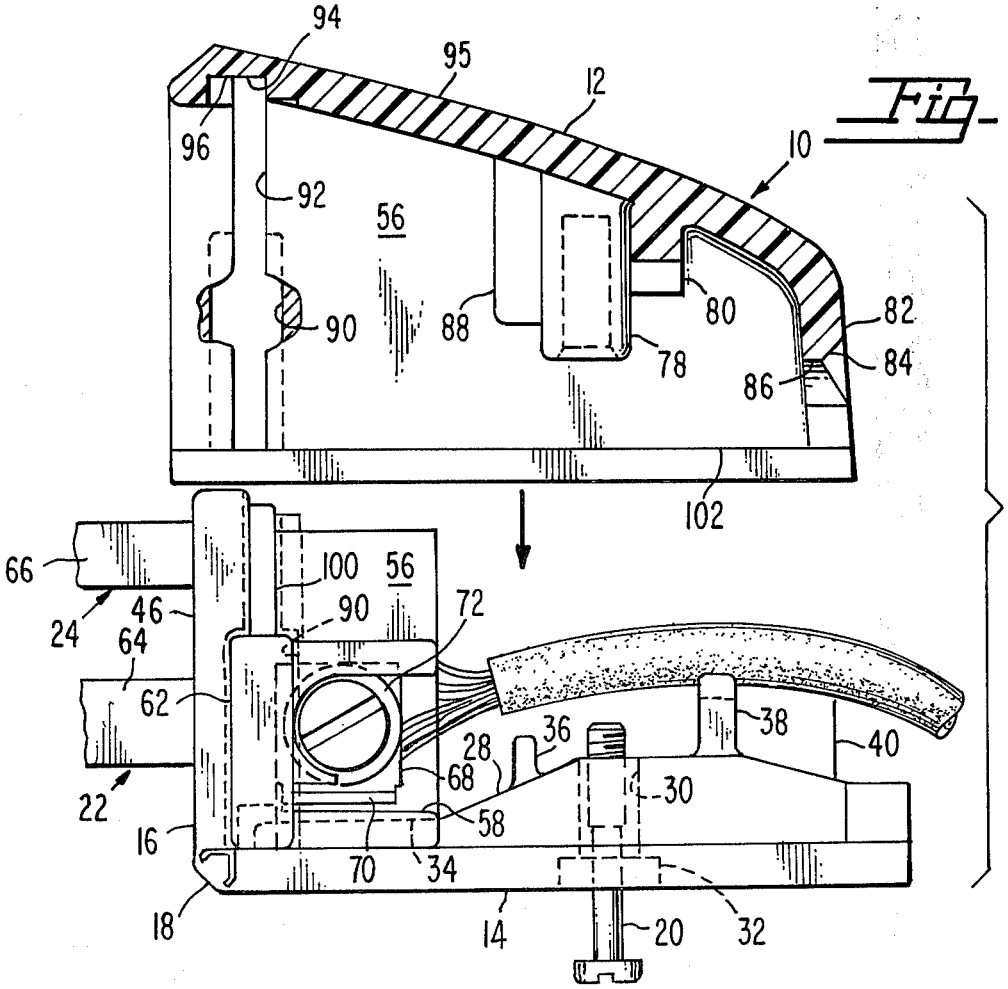
FIG. 7 is an exploded view partly in side elevation and partly in longitudinal section, in which the dead-front has been swung upwardly from its initial wiring position shown in FIG. 6, to its use position, and in which the cover is illustrated preliminary to its being assembled with the body and dead-front.

The cover has an interlocking relationship with the dead-front, when the dead-front is swung upwardly from its initial wiring position shown in FIG. 5 to its end use position shown in FIGS. 7 and 8. As seen from FIG. 8, and also from FIG. 7, the cover 12 is formed, in its opposite sidewalls adjacent its enlarged head end, with dove-tail locking grooves 90, communicating with narrower side grooves 92. The side grooves open upon the inner faces of the respective sidewalls of the cover, and extend the full height of the cover.

The side grooves 92 thus open upon the respective opposite longitudinal edges of the cover, and extend within the respective sidewalls of the channel-shaped cover, merging at their inner ends into a connecting groove 94 that extends the full distance between the side grooves 92, within the web portion 95 of the cover. There is, thus, in closely spaced relation to the head and edge of the cover, a continuous transverse groove comprised by the side grooves 92 and the connecting groove 94, that extends without a break fully from one longitudinal edge to the opposite longitudinal edge of the cover, in the inner surface of the cover. This continuous groove receives the side and outer end edges of the body part 46 of the dead-front, when the dead-front is in its use position shown in FIG. 8. The dove-tail locking groove 90 formed in each sidewall of the cover opens upon the adjacent longitudinal edge of the cover and extends inwardly through approximately half the transverse dimension of each sidewall, as best shown in FIG. 7. In the assembled relationship of the parts with the dead-front in its use position, the locking tongues 62 formed on the opposite side edges of the dead-front are received within the mating dove-tail grooves 90 of the cover.

In the inner surface of the web portion 95 of the cover, there is formed a widened or enlarged central part 96 of the connecting groove 94, located midway between the opposite sides of the cover. This is adapted to receive a locking lug 98 integrally molded upon the front end edge of the body part 46 of the dead-front (see FIGS. 6 and 8), when the several components have been fully assembled in their end use positions.

Figure 10:
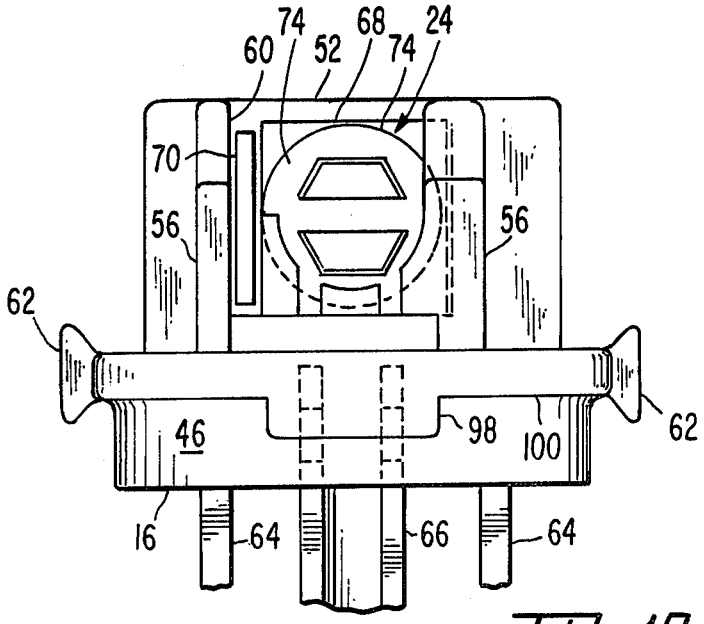
FIG. 10 is an end elevational view of the dead-front as seen from line 10—10 of FIG. 5.

To permit the body part 46 to lockingly engage in the continuous groove defined by the side grooves 92 and connecting groove 94, said body part is formed with a peripheral lip or flange 100, merging into the dove-tail locking tongues 62 (see FIGS. 6, 8, and 10).

Referring to FIG. 7, it will be observed that extending the full length of each longitudinal or side edge of the cover 12, there is formed a longitudinal recess 102. Recesses 102 receive the opposite longitudinal edges of the base portion 26 of the member 14 in the assembled relation of the parts. Thus, there is provided an effective, tight closure of the first and second sidewall members, along their contacting longitudinal edges, when the housing is fully assembled.

In use of the device illustrated in FIGS. 1 through 12, initially the parts appear as in FIG. 5. At this time, the ends of the current-carrying and ground conductors of the power cord are stripped a short distance, and with the dead-front extended in substantially co-planar relation to the base portion 26, the stripped ends of the current-carrying conductors C and of the grounding conductor G are secured to their associated terminals, being clamped between the nuts 70 and the associated heads of the contact elements. The arrangement illustrated facilitates to the maximum degree the wiring of the device in the manner described, since the several terminals are completely and fully exposed, thus affording maximum ease and speed in the wiring operation.

With the wire ends connected to their associated terminals, the wire is simply laid within the central portion of the base portion 26 of member 14, and this swings the dead-front from the FIG. 5 to the FIG. 7 position thereof. With the power cord now disposed as in FIG. 7 and the dead-front now in its end use position, one simply moves the cover 12 toward the dead-front and body as shown in FIG. 7. The dove-tail grooves 90 receive the tongues 62, and the tongues slidably engage in the locking grooves 90, until the cover is in its final position shown in FIG. 8. When the cover moves to its final position, the peripheral flange 100 of the dead-front, which extends continuously along the side and outer end edges of the body part 46 of the dead-front, are received within the side and connecting grooves 92, 94 of the cover. The enlarged portion or lugs 98 formed upon the lip or flange 100 engages in the mating part 96 of connecting groove 94.

The assembly screws 20 are now utilized, being threaded into the recesses 89 of the cover. As a result, the cover and the body are tightly connected by means of the assembly screws, and this in turn causes the cover to interlock securely with the dead-front, providing an effective seal around the side and end edges of the dead-front. In these conditions, if the hinge 18 should rupture, there would be no loss of the sealing action, because the tight engagement between the dead-front and the cover is such as to prevent any movement of the dead-front relative to the cover or body, from the end use position of the several parts shown in FIG. 8.

The connection of the cover to the body effected responsive to inward threading of the assembly screws is also efffective to produce a strong clamping or gripping action exerted upon the strain-relieved power cord PC by and between the cover and the body. As a result, in the ordinary use of the device, any pull upon the power cord, to disengage the connector from a mating electrical connecting device, will not be transmitted to the terminal connections, but rather, will be absorbed by the strain-relief formations provided internally of the housing.

Figure 13:
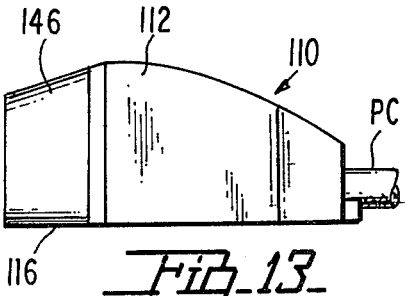
FIG. 13 is a side elevational view of a modified form illustrating the invention as it appears when designed as a female cord connector.
Figure 14:
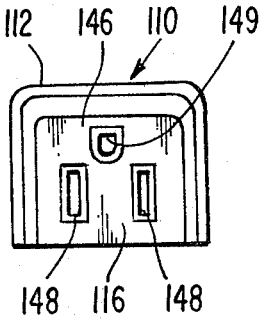
FIG. 14 is a front elevational view of the connector shown in FIG. 13.
Figure 15:
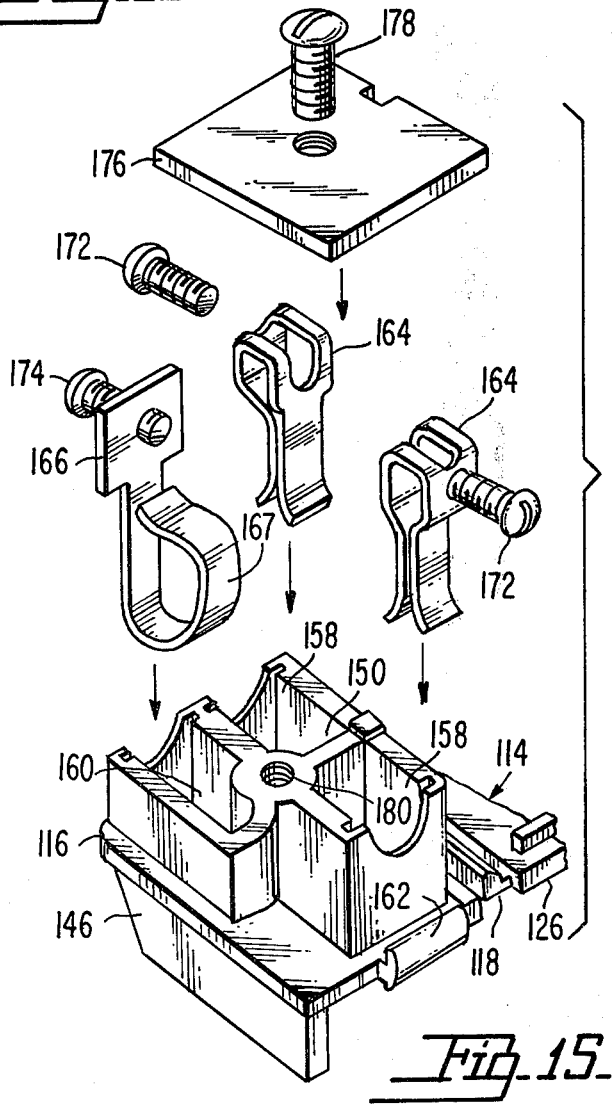
FIG. 15 is a fragmentary, exploded perspective view illustrating the opened dead-front, the contact elements, and the associated components of the cord connector illustrated in FIGS. 13 and 14.

In FIGS. 13–15, there has been illustrated a modified form. This shows the invention applied to a cord connector, in which the contacts are of the female type and are adapted to mate with the blade elements of the attachment plug illustrated in FIGS. 1 through 12. In this form of the invention, the cover has the same construction as has been illustrated and described with respect to FIGS. 1–12. The cover 112, thus, is of channeled formation, tapering toward its rear end as shown in FIG. 13.

The same is true of the body 114, which accordingly has been illustrated only fragmentarily in FIG. 15. The portions of the body or first sidewall member 114 that have not been illustrated in FIGS. 13–15 will be understood as being formed similarly to the body 14. The same is true of those portions of the cover or second sidewall member 12, with respect to those portions of said second sidewall member that have not been specifically illustrated in FIGS. 13–15.

In any event, the device shown in FIGS. 13–15 differs from the first form of the invention only with respect to the design of the dead-front or end wall member 116. This is so formed as to project forwardly from the head end of the cover 112, as shown in FIG. 13, a distance sufficient to accommodate the lengths of the contact elements illustrated in FIG. 15.

Accordingly, it may be considered that in the form of the invention shown in FIGS. 13–15, there is a housing generally designated 110, including first sidewall member 112, second sidewall member 114, and end wall member 116 connected to the second sidewall member by means of a hinge 118. Member 114 includes, similarly to the first form of the invention, a flat base portion 126.

Formed in the thickened body part 146 of end wall member or dead-front 116 are blade slots 148 providing access to the current-carrying female contact elements housed within the dead-front, and a ground contact slot or opening 149 adapted to provide access to the ground contact. The slots 148 open into recesses 158 adapted to receive the current-carrying contact elements, and slot 149 opens into the ground contact recess 160 (see FIG. 15).

In this form of the invention, as in the first form, the body part 46 has a peripheral locking flange, and in addition, as in the first form of the invention there are provided dove-tail locking tongues 162 at opposite sides of the body part 146.

The current-carrying contact elements in this form of the invention have been designated at 164, and are conventional in and of themselves, in receptacles of the type utilized in various electrical appliances. Thus, they are of the folded type, and are formed with threaded openings adapted to receive terminal screws 172. Similarly, the ground contact element 166 is also well known in and of itself, and is adapted to provide a looped contact surface 167 having a springability sufficient to cause it to firmly engage a ground prong of the type illustrated at 66. A ground terminal screw 174 is threadedly engaged in the head end of the ground contact element 166.

The several contact elements 164, 166 are dropped into the recesses 158, 160 respectively, and thereafter a fiber hold-down cover element 176 is positioned thereover. Element 176 has a central opening receiving a connecting screw 178 threadedly engageable in threaded recess 180 formed in the dead-front.

With the contact elements assembled in the dead-front as described above, and with the cover element 176 secured in place, the screws 172 can be backed off sufficiently to receive the looped ends of the associated power cord. In this form the stripped ends of the cord are clamped between the screw heads and the heads of the contact elements. Then, the power cord is laid into the first sidewall member 114, with the dead-front swung upwardly to its use position shown in FIG. 13. The cover 112 is applied in the same manner as in the first form of the invention, and assembly screws are used to connect the cover to the body in interlocking relationship to the dead-front. As a result, there is provided a cord connector adapted to mate with the attachment plug of FIGS. 1–12, and having the same characteristics with respect to ease of wiring, ease of assembly, and effective interlock as is true of the attachment plug cap version of the invention.

While particular embodiments of this invention have been shown in the drawings and described above, it will be apparent, that many changes may be made in the form, arrangement, and positioning of the various elements of the combination. In consideration thereof it should be understood that preferred embodiments of this invention disclosed herein are intended to be illustrative only and not intended to limit the scope of the invention.

I claim:

1. A dead-front electrical connecting device for attachment to a power cord of the plural conductor type, comprising:

(a) a plurality of contact assemblies, each of which includes a contact element and a terminal adapted for connection to one of the conductors of a power cord;

(b) a two-piece housing including (1) a first piece of electrical insulation material including an elongated, generally flat base portion formed intermediate its ends with a pair of transversely spaced openings and with at least one transversely extended strain relief rib, said piece including a generally flat end wall member integrally hinged to one end of the base portion and swingably through approximately 90° between a wiring position in which it is generally co-planar with and is a longitudinal extension of the base portion, and a second position in which it becomes a dead front on the housing and is disposed generally at right angles to the base portion, said contact assemblies being mounted on the end wall member with the terminal disposed in the angle included between the base portion and the end wall member when the end wall member is in its dead front position, the end wall member having opposed side edges formed with locking tongues;

(2) a second piece formed wholly separately from the first piece and having an elongated channel shape so as to include a web and a pair of side flanges, the second piece having opposed grooves in the side flanges adapted to slidably receive and interengage with the locking tongues responsive to movement of the second piece bodily toward the first piece, the second piece embracing the end wall member when the tongues and grooves are interengaged, the second piece having openings registering with those of the base portion when the tongues and grooves are interengaged, said second piece including at least one transverse strain relief rib cooperating with that of the base portion in clampably engaging the conductors of a power cord when the conductors are disposed between the base portion and the second piece and are connected to the terminals; and (c) assembly fasteners extending through the respective registers openings of the base portion and the second piece for connecting the pieces in an assembled relationship in which they define a dead front housing fully enclosing the terminals.

2. A dead-front electrical connecting device for attachment to a power cord of the plural conductor type, comprising:

(a) a plurality of contact assemblies, each of which includes a contact element and a terminal adapted for connection of one of the conductors of a power cord;

(b) a two-piece housing that includes (1) a first piece formed of two members connected by an integral hinge about which one of the members is swingable to a position in which it becomes a dead front upon which the contact assemblies are mounted, said one member, when in its dead front position, being substantially at a right angle to the other member with the terminals disposed within the angle defined between the members and having opposed side edges formed with locking tongues;

(2) a second piece formed wholly separately from the first piece and having an elongated channel shape so as to include a web and a pair of side flanges, the second piece having opposed grooves in the side flanges adapted to slidably receive and interengage with the locking tongues responsive to movement of the second piece bodily toward the first piece, the locking tongues and the opposed grooves, when interengaged, providing a fixed relationship between said one member and said second piece, said first piece and said second piece cooperating to define an enclosure in which the terminals are confined; and (3) fastener means connecting the pieces in the enclosure-defining relationship thereof.

3. A dead-front electrical connecting device for attachment to a power cord of the plural conductor type, comprising:

(a) a plurality of contact assemblies, each of which includes a contact element and a terminal adapted for connection to one of the conductors of a power cord;

(b) a housing including (1) a first side wall member;

(2) a second side wall member;

(3) an end wall member adapted to be completely detached from one of the side wall members to expose the terminals of the contact assemblies to permit the conductors of the power cord to be connected thereto during installation of the power cord, the several members being formed of an electrically insulative material, the end wall member being movable to a position in which it extends across one end of the housing as a dead front therefor, the contact assemblies being mounted on the end wall member with their terminals in back of the dead front and the end wall member being hinged to the other side wall member to swing between a wiring position in which the terminals are exposed to facilitate connection of the conductors of the cord thereto, and its dead front position; and (4) means for assembling the members with the end wall member in its dead front position and the side wall members cooperating with it to enclose the terminals, said housing including interlocking means on the end wall member and on said one side wall member adapted to interconnect the same in the assembled condition of the several members, one of the interconnected members having parallel tongues and the other having locking grooves slidably receiving the tongues responsive to movement of said one side wall member toward the other side wall member in a path paralleling the tongues and grooves with the end wall member in its dead front position;

in which the means for assembling the members comprises assembly screws connecting the respective side wall members to each other;

in which the assembly screws are adapted to draw the respective side wall members toward each other in a path paralleling the tongues and grooves; and in which said one side wall member is generally channel-like in cross section so as to include a web portion and side flange portions embracing the end wall member when the several members are assembled, the grooves being formed on the side flange portions and the end wall member having opposite side edges on which the tongues are formed.

4. An electrical connecting device as in claim 3 wherein, in the assembled condition of the several members, the respective side wall members define a power-cord-receiving entrance opening at the other end of the housing.

5. An electrical connecting device as in claim 4 in which the respective side wall members include confronting strain relief means for clampably engaging, in the assembled condition of the several members, a cord extended through said entrance opening and engaged with the enclosed terminals.

6. A dead-front electrical connecting device for attachment to a power cord of the plural conductor type, comprising:

(a) a plurality of contact assemblies, each of which includes a contact element and a terminal adapted for connection to one of the conductors of a power cord;

(b) a housing including (1) a first side wall member;

(2) a second side wall member;

(3) an end wall member adapted to be completely detached from one of the side wall members to expose the terminals of the contact assemblies to permit the conductors of the power cord to be connected thereto during installation of the power cord, the several members being formed of an electrically insulative material, the end wall member being movable to a position in which it extends across one end of the housing as a dead front therefor, the contact assemblies being mounted on the end wall member with their terminals in back of the dead front and the end wall member being hinged to the other side wall member to swing between a wiring position in which the terminals are exposed to facilitate connection of the conductors of the cord thereto, and its dead front position; and (4) means for assembling the members with the end wall member in its dead front position and the side wall members cooperating with it to enclose the terminals;

said housing including interlocking means on the end wall member and on said one side wall member adapted to interconnect the same in the assembled condition of the several members, one of the interconnected members having parallel tongues and the other having locking grooves slidably receiving the tongues responsive to movement of said one side wall member toward the other side wall member in a path paralleling the tongues and grooves with the end wall member in its dead front position;

wherein the tongues and grooves are dove-tail tongues and dove-tail grooves which lockably engage upon movement of said one side wall member toward the other side wall member in a path paralleling the tongues and grooves with the end wall member in its dead front position.

* * * * *

UNITED STATES PATENT AND TRADEMARK OFFICE

CERTIFICATE OF CORRECTION

PATENT NO. :4,420,204

DATED :Dec. 13, 1983

INVENTOR(S) :Henry Leong

It is certified that error appears in the above-identified patent and that said Letters Patent are hereby corrected as shown below:

Column 5, Line 21, after "blade" insert -- slots --

Column 9, Line 34, change "swingably" to --swingable--

Column 9, Line 67, change "registers" to -- registered --.

Signed and Sealed this

*Twenty-ninth* Day of *May 1984*

[SEAL]

*Attest:*

GERALD J. MOSSINGHOFF

*Attesting Officer*

*Commissioner of Patents and Trademarks*